US006148902A

United States Patent [19]

Zielinski et al.

[11] Patent Number: 6,148,902

[45] Date of Patent: Nov. 21, 2000

[54] MULTIPLE DIE CASTING MACHINES WITH SINGLE VACUUM SOURCE

[75] Inventors: Michael D. Zielinski, Pewaukee; Edward M. Nelson, Franklin; Walter H. Yelczyn, Milwaukee; David M. Regenauer, Franklin, all of Wis.

[73] Assignee: Outboard Marine Corporation, Waukegan, Ill.

[21] Appl. No.: 08/943,866

[22] Filed: Oct. 8, 1997

[51] Int. Cl.[7] ..... B22D 17/14; B22D 17/32

[52] U.S. Cl. ..... 164/457; 164/4.1; 164/61; 164/63; 164/113; 164/253; 164/254; 164/305

[58] Field of Search ..... 164/61, 113, 63, 164/65, 457, 4.1, 253, 254, 305, 312

[56] References Cited

U.S. PATENT DOCUMENTS

| | | | |
|---|---|---|---|
| 4,055,216 | 10/1977 | Ulyanov et al. | 164/65 X |
| 4,129,164 | 12/1978 | Torikai | 164/65 X |
| 5,219,409 | 6/1993 | Campbell et al. | 164/113 X |
| 5,269,362 | 12/1993 | Yamashita . | |
| 5,343,933 | 9/1994 | Schneider et al. . | |
| 5,379,826 | 1/1995 | Miwa et al. | 164/4.1 |
| 5,511,605 | 4/1996 | Iwamoto | 164/457 |

FOREIGN PATENT DOCUMENTS

| | | | |
|---|---|---|---|
| 58-55167 | 4/1983 | Japan | 164/61 |
| 1250335 | 10/1971 | United Kingdom | 164/253 |

*Primary Examiner*—J. Reed Batten, Jr.
*Attorney, Agent, or Firm*—Armstrong Teasdale LLP

[57] ABSTRACT

A vacuum die casting system has three die casting machines connected to a single vacuum system, all of which is controlled by a programmable logic controller. The controller allows any two of the machines to be operatively connected to the vacuum system so that the casting operation of those two machines are performed under vacuum. The controller comprises six address relays, a sixteen channel input card, a processor, a sixteen channel output card, an interface and two high speed counter cards. The result is an efficient, reliable, and economical vacuum die casting system.

10 Claims, 2 Drawing Sheets

MULTIPLE DIE CASTING MACHINES WITH SINGLE VACUUM SOURCE

BACKGROUND OF THE INVENTION

1. Field of the Invention

The present invention relates to a vacuum die casting method and system and, more particularly, to a system and method in which multiple die casting machines are connected to and function with a single vacuum apparatus resulting in a simple, efficient and low cost arrangement that produces better and stronger castings.

2. Description of the Related Art

Die casting is based upon the principle of forcing molten metal into a mold or die under considerable pressure. This technique makes possible the economical production of intricate castings at a rapid rate. Such castings, which, for example, may comprise various holes, recesses, screw threads, and shapes, are characterized by high dimensional accuracy, good surface finishes and economy of metal. Such castings require little or no final machining.

A typical cycle of operation comprises closing the die, using a plunger to force forcing the molten metal into the die cavity, withdrawing any cores, pausing for a predetermined time, opening the die, ejecting the casting, shearing off the sprue, deburring the casting and cleaning the die. The number of cycles per hour that a casting machine can attain will depend on the size and shape of the castings and on the casting metal used. Typically, casting dies are very expensive because they are precision made and they are of quality materials to survive severe working conditions characterized by high pressures and numerous variations in temperature. For the production of zinc and zinc alloy castings, the dies may be made of unalloyed steel. For aluminum, however, and for magnesium and copper and the alloys of these metals, the dies are usually made of hot worked tool steel which has greater durability.

More recently, a pressure reducing or vacuum apparatus has been developed which cooperates with a die casting machine to produce even stronger castings with finer surfaces. When using a vacuum apparatus, the air in the system is mostly evacuated, and the metal is pulled into the die as well as pushed. Typically, the vacuum apparatus includes a pump, an electric motor, a receiver and a hose.

Most recently, vacuum die casting systems have been joined to programmable logic controllers, valve assemblies, actuator assemblies and related process piping and electrical connections. Signals from the die casting machine, including the position of the plunger and a start-of-cycle signal are sent to the controller which in turn signals the vacuum apparatus to assist in the casting process. Upon receiving a start-of-cycle signal from a die casting machine, the vacuum system is energized. The valve is opened to expel excess metal from the previous cycle that may be present and to test for blockage around the valve and to test the vacuum hose. The valve is then closed and the receiver and the hose is evacuated. The pump is isolated from the system and a test for pressure decay is performed. If either of two these tests show a problem, a light on a control panel is lit and the die casting machine ceases operation. While the testing is undertaken, the casting from the previous cycle is removed from the die cavity and the die is sprayed with a release coating for the next cycle.

After the tests have been completed, the die is closed and locked and the molten metal, usually aluminum, is poured into a chamber. The injection plunger is energized and moved slowly past the pour hole. Once the pour hole has been sealed, a signal is sent to the vacuum apparatus. The vacuum valve is opened by the actuator allowing the removal of air from the die cavity and chamber. As the plunger movement continues, the low pressure is maintained. If the low pressure level cannot be held below a preset level, a signal is produced and the casting cycle is halted. Before the molten metal, which is being forced and sucked into the die cavity, reaches the vacuum valve at the far end of the flow path, the actuator allows the valve to close.

While vacuum die casting has certain advantages over ordinary die casting, not all castings need be exposed to a vacuum or low pressure operation, and maintaining a full system including a die casting machine and a vacuum apparatus is a considerable investment, especially when a manufacturer has multiple die casting machines. Trying to enhance efficiency in these circumstances proved to be an interesting task which has heretofore escaped solution.

BRIEF DESCRIPTION OF THE INVENTION

The problem described above has been overcome by the present invention in which a method for reducing pressure in casting cavities of more than one preselected die casting machine using a single pressure reducing source is disclosed comprising the steps of providing a plurality of die casting machines, each machine providing signals based upon a die casting operating cycle; providing a pressure reducing source; providing a valve for each of the plurality of die casting machines, the valves for communicating the casting cavities of the plurality of die casting machines with the pressure reducing source; selecting some of the plurality of die casting machines to be subjected to pressure reduction; communicating the signals from one of the plurality of preselected die casting machines to a first receiving element; communicating signals from the first receiving element to a controller; communicating signals from the controller to the pressure reducing source; reducing pressure in the casting cavity of the one preselected die casting machine; communicating the signals from another of the preselected die casting machines to a second receiving element; communicating signals from the second receiving element to the controller; communicating signals from the controller to the pressure reducing source; and reducing pressure in the casting cavity of the other preselected die casting machine.

The invention also includes a vacuum die casting system comprising in combination a plurality of die casting machines, each die casting machine having a casting cavity and each die casting machine providing signals based upon a die casting operating cycle; a pressure reducing source connected to the plurality of die casting machines; means connecting the plurality of die casting machines and the pressure reducing source for removing gas from the casting cavities of the plurality of die casting machines; a plurality of valves, each valve being mounted to a corresponding die casting machine and in communication with the casting cavity of the corresponding die casting machine; a programmable logic controller including an operator interface connected to the plurality of die casting machines and to the pressure reducing source; means connected to the plurality of die casting machines for transmitting signals from preselected die casting machines to the programmable logic controller; and means connected to the programmable logic controller for transmitting signals to the pressure reducing source in response to signals received from the preselected die casting machines.

It is an object of the present invention to provide a vacuum die casting system where multiple die casting machines are connected to a single vacuum source. Another aim of the present invention is to provide a vacuum die casting system which is reliable, efficient and economical. Yet another advantage of the present invention is to provide a vacuum die casting system which minimizes manufacturing floor space. Still another aspect of the present invention is to provide a vacuum die casting method in which casting cavities for a multiple number of die casting machines are evacuated by a single pressure reducing apparatus.

A more complete understanding of the present invention and other objects, aspects, aims and advantages thereof will be gained from a consideration of the following description of the preferred embodiment read in conjunction with the accompanying drawings provided herein.

DESCRIPTION OF THE PREFERRED EMBODIMENTS

Figure 1:
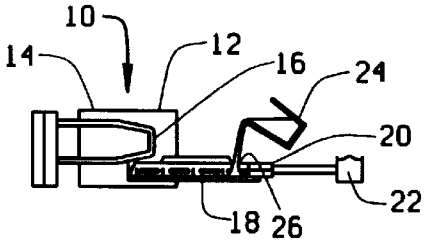
FIG. 1 PRIOR ART
FIG. 1 is a diagrammatic view of a prior art die casting machine showing the basic elements of a machine in the first step of the die casting process and illustrating the filling of a chamber with molten metal.

While the present invention is open to various modifications and alternative constructions, the preferred embodiment shown in the drawings will be described herein in detail. It is to be understood, however, that there is no intention to limit the invention to the particular form disclosed. On the contrary, the intention is to cover all modifications, equivalent structures and alternative constructions falling within the spirit and scope of the invention as expressed in the appended claims.

Figure 2:
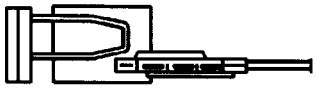
FIG. 2 PRIOR ART
FIG. 2 is a diagrammatic view of the apparatus shown in FIG. 1 illustrating the casting of an item as molten metal is forced into the die cavity.
Figure 3:
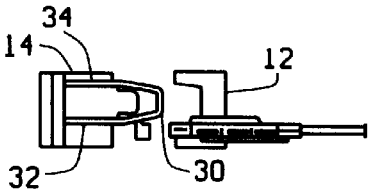
FIG. 3 PRIOR ART
FIG. 3 is a diagrammatic view of the apparatus shown in FIGS. 1 and 2 illustrating the ejecting of a casting to complete a casting cycle.

Referring now to FIGS. 1, 2 and 3, there is illustrated the operation of a die casting machine sometimes referred to as a horizontal cold-chamber system. The machine 10 includes a mold or die having a fixed block 12 and a horizontally movable block 14, a die cavity 16, an entry chamber or shot sleeve 18, and a plunger 20. The plunger is movable in the chamber under the influence of a hydraulic cylinder 22. Molten metal 24 is poured into an opening 26 after the two mold blocks 12 and 14 have been brought together and locked. As shown in FIG. 2, the hydraulic cylinder pushes the plunger to the left forcing the molten metal into the die cavity. After a predetermined period of time, the movable block 14 moves to the left, away from the stationary block 12, as illustrated in FIG. 3, exposing the casting 30. The casting is then pushed away from the mold by ejector pins 32, 34, thereby completing a casting cycle. Of course, while only the basic steps of the casting cycle and the elements of a die casting machine have been disclosed, those in the field understand that other elements and steps must be taken in a typical die casting operation.

Figure 4:
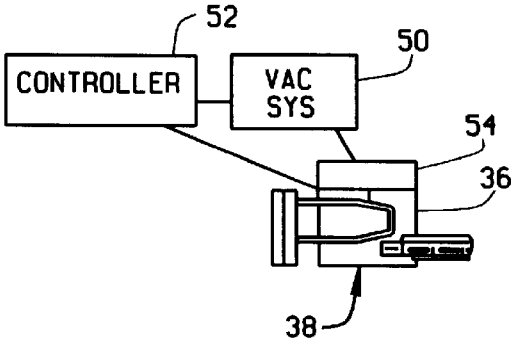
FIG. 4 PRIOR ART
FIG. 4 is a diagrammatic view of a prior art vacuum die cast system illustrating the basic elements, including a vacuum apparatus, a controller and a die casting machine.

Referring now to FIG. 4, a die casting machine and a vacuum apparatus is illustrated. The die casting machine is similar to that described in relation to FIGS. 1–3, and it operates in a similar manner. However, the machine is connected to a vacuum apparatus 50 and a controller 52. The vacuum apparatus typically consists of an electric motor operating a pump which in turn is connected to an empty tank called a receiver. The receiver in turn is connected through appropriate pipes or hoses to a valve 54 adjacent to and in communication with the casting cavity 36 in the die 38.

The controller is connected to both the die casting machine and the vacuum apparatus, the operation of the vacuum apparatus being determined by the cycle of the die casting machine. Three signals are provided by the die casting machine to the controller. First, a signal is generated when the plunger is at a predetermined position for opening the valve 54 thereby causing the cavity 36 to be evacuated, or stated in another way, the pressure in the cavity is substantially reduced. At another predetermined position of the plunger the valve closes, and when the blocks separate and the ejector pins move forward, as shown in FIG. 3, another signal is provided causing the vacuum system to test itself.

It should be understood that the vacuum system is a system for pumping air out of a region thereby reducing the pressure in that region. A true vacuum is never achieved but a substantial reduction in pressure is, perhaps as low as 26 or 27 inches of mercury. When the vacuum system removes the majority of the air in the casting cavity thereby reducing the pressure in the cavity, the metal which is being pushed into the cavity from an opposite direction, is able to flow more easily and quickly into the cavity and, more importantly, there is less air to be trapped in the casting, itself, after the metal solidifies. Two advantages of vacuum die casting are that the surface of the casting is noticeably improved, and the strength of the casting is increased because there are fewer air pockets.

Figure 5:
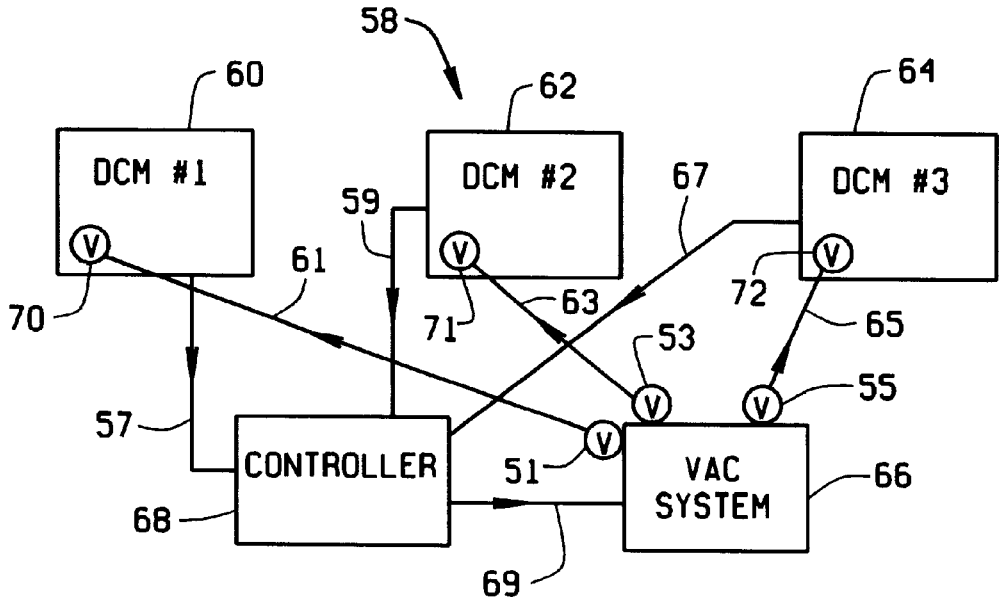
FIG. 5 is an diagrammatic block diagram showing three die casting machines connected to a single vacuum system according to the present invention.

The simple, efficient and inexpensive system and method of the present invention may be appreciated by reference to FIG. 5. There is illustrated a system 58 including a plurality of die casting machines in the form of three die casting machines, die casting machine no. one 60, die casting machine no. two 62 and die casting machine no. three 64; the machines are in operative engagement with a single vacuum system or pressure reducing source 66, and they are activated by a controller 68. The vacuum system, comprising a pump, an electric motor and a receiver, is connected by hoses or pipes to each of the die casting machines. For example, the vacuum system is connected to the machine 60 by the hose 61, to the machine 62 by the hose 63, and the machine 64 by the hose 65. In line with each hose is a ball valve, such as the ball valves 51, 53 and 55, respectively. Also in line with the vacuum hoses are the valves in communication with the casting cavities. These include poppet valves 70, 71 and 72, respectively. The poppet valves have biasing springs and are each mated with a solenoid driven actuator which, when energized, cause the valve to open. When the solenoid is no longer energized the biasing spring closes the valve. The solenoid closes its corresponding poppet valve in 6–8 milliseconds. This speed is achieved by actually using two solenoids for each valve, one large and one small. The large and small solenoids simultaneously open the valve, but after a time the large solenoid is de-energized, and the valve is held open by the small solenoid. The small solenoid is strong enough to hold the valve open but not strong enough to overcome the initial spring and valve opening forces. By using only the small solenoid, inertia is reduced and the valve may be closed more quickly.

The controller 68 is connected to each machine and the vacuum system by electrical wires, such as the wire 57 connecting the controller to the machine 60, the wire 59 connecting the machine 62, the wire 67 connecting the machine 64 and the wire 69 connecting the vacuum system 66. The vacuum system evacuates the cavity, the runners and the chamber in less that 75 milliseconds. The result is a casting of uniform quality with improved fill-out and reduced porosity. The higher integrity of the material permits reduced wall thicknesses for lighter weight and lower cost.

Signals are generated by predetermined events of the die casting cycle. For example, a first signal is generated by the die casting machines at the time the ejector pins are moved forward or a signal is generated by an automatic extractor, indicating that the casting cycle is over. This signal goes to the controller 68 and indicates that the die casting machine from which the signal has come is ready to start a new die casting cycle.

At this time a first test is performed. The mold is open and the poppet valve is also opened so that air may be sucked through the valve and corresponding hose by the pump clearing the apparatus from the pump to the poppet valve. Any small beads of casting metal left from the previous cycle will be removed, and it will not interfere with the operation of the poppet valve. If this test is successful, the system proceeds to the next step. If this test is not successful, a warning light is activated at the controller and a fault signal is sent to the die casting machine being tested indicating that there is a problem.

Next, a second test is performed. The cavity is lubricated to facilitate the removal of the next casting. Typically, a "mold release" is sprayed on the cavity walls. Then the system is brought down to a low pressure, for example, 26 or 27 inches of mercury, and a predetermined time period is allowed to elapse before the pressure is read again to determine whether there is a large decay. For example, if after five seconds, the pressure has not risen to 20 inches of mercury, the cycle then moves forward. If the vacuum decay or pressure increase during the predetermined time is too great indicating a leak in hoses, connectors or valve, a fault light on the controller is activated, and a fault signal is sent to the die casting machine.

The next step in the cycle is to retract the ejector pins and move the movable mold block into abutment with the stationary mold block and where they are locked. At this time another signal is generated and that part of the system from the receiver through the hose to the poppet valve is evacuated or reduced in pressure in readiness for the next injection of molten metal. The molten metal is then poured into the chamber and the plunger is moved forwardly past the fill hole. The plunger usually moves at a "slow" rate of about 23 inches per second. High speed counters signal the solenoids to open the poppet valve, and air is evacuated from the chamber, the runners and the cavity. Water vapor is also removed. The evacuation can occur in as little as 50 milliseconds.

The low pressure in the system is continuously monitored while the plunger continues its movement toward the casting cavity. If the pressure is within predetermined parameters then the casting cycle continues. If not, a fault signal is indicated and a light flashes on the controller panel. At a second predetermined position of the plunger or at a predetermined velocity of the plunger, another signal is provided which de-energizes the solenoid, thereby causing the poppet valve to close under the influence of the associated biasing spring. In this way, molten metal moves up to the poppet valve but not beyond it. If casting metal moves beyond the poppet valve seat, it will interfere with proper operation of the valve and the excess metal will have to be removed by an operator. To prevent this from happening, the runner between the poppet valve and the cavity includes four 90° turns to slow the flow of metal.

At some point the piston moves at its maximum velocity, sometimes referred to as "fast shot", where the molten metal is slammed into the die cavity. The plunger velocity may be at about 90 inches per second. The die remains closed for a predetermined period of time to allow the casting to cool and harden. This is followed by the cores being removed (if used) and the casting is ejected. The cycle begins again when the first signal indicating that the ejector pins have been moved forward. Typically, the metals used are aluminum, zinc or magnesium or alloys of these metals. Any casting material is suitable, however.

Generally, the power supply contemplated for the vacuum system is a 460 or 575 volt, 3-phase, 20 amp circuit if a 5 to 7.5 horsepower pump is used or a 30 amp circuit if a 10 to 15 horsepower pump is used. Preferably the signals from the die casting machine are 120 volt AC signals. A position encoder that generates a 0, 5 volt quadrature signal may be used to operate the poppet valve through a counter module.

Figure 6:
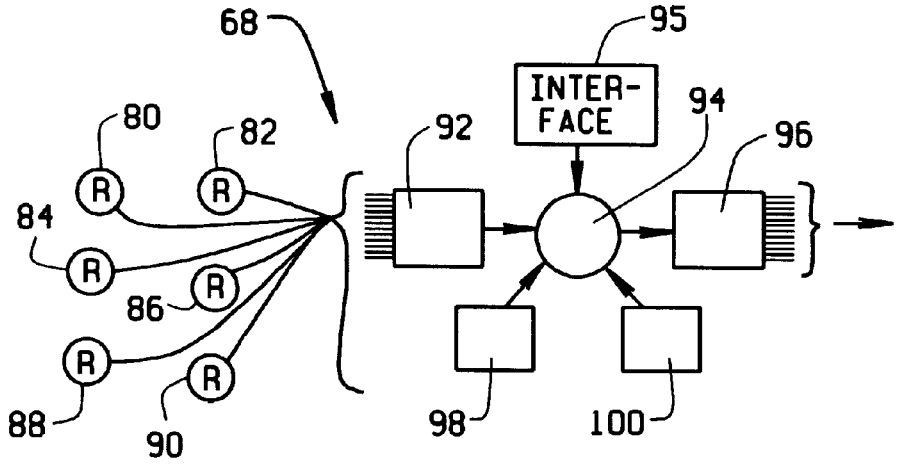
FIG. 6 is a flow diagram illustrating the operation of a programmable logic controller of the present invention.

Referring now to FIG. 6, the controller 68 comprises six signal receiving elements or address relays 80, 82, 84, 86, 88 and 90 for receiving the signals from the die casting machines, three relays for each of the two machines selected to be connected to the vacuum system. The address relays are provided to receive a wide variety of signals since the individual die casting machines already on a site may be of different manufacture whose signal may vary within a wide range. Thus, the inventive system may be constructed as an "after market" unit or the die casting machines and vacuum system may be installed as a complete system. The relays, in turn, change state to provide a consistent signal to a sixteen channel input card 92. Software, in the form of a processor 94 directs the signals in a predetermined manner to a sixteen channel output card 96. (The processor, through a series of move statements, shuttles each of the die casting machines unique set points to the proper registers.)

A system operator uses an interface 95 to select two of the three die casting machines to be connected to the vacuum system. The interface may be a keyboard and a screen. The disclosed embodiment having three die casting machines and a single vacuum source is configured to allow the vacuum source to connected to any two of the machines at any one time. The controller identifies each machine as numbers 1, 2 or 3 and the vacuum source as numbers 1 or 2. The operator, by setting the system matches one of the machines with "one" of the vacuum sources. This insures that one machine is not connected to both vacuum sources at the same time. The system also allows a switch from one die casting machine to another using "one" vacuum source without disruption of the "other" vacuum source that the third machine it is already operating with. Two high speed counter cards 98 and 100 are also provided for generating signals based upon the velocity of the plunger. The output signals communicate with the vacuum system and provides the evacuation of the casting cavities at the proper time in the cycle and at the proper time closes the poppet valve.

It should be understood that while the system described here is based upon the use of single vacuum system to evacuate any two of three die casting machines, with appropriate modifications such as a large pump and receiver, and the enlargement of the controller, additional die casting machines can be handled by a single vacuum system. Or, referring to the preferred embodiment, all three of the die casting machines can be handled by the single vacuum source by enlarging the controller.

The programmable logic controller 68 may be purchased from the Allen-Bradley Company of Milwaukee, Wis., Model SLC500. The cards may also be purchased from Allen-Bradley, the sixteen channel input card being Model 1747-IA16, the sixteen channel output card being Model 1747-OA16, and the high speed counter cards being Model 1746-HSCE.

The casting quality advantages achieved by the present invention could have been accomplished by using an individual vacuum system with each die casting machine. However, the centralized approach means that the vacuum system and the die casting machines are hard wired and piped together. To transfer the vacuum system from one die casting machine to another is merely a process of keystroking the operator interface accordingly. Since each vacuum system costs approximately $40,000–$50,000, a major advantage of the present system is that there is a higher machine utilization, lower overall cost and more efficient use of space. The centralized system of the present invention costs approximately 25% less on a per machine basis than the systems of the prior art.

The specification describes in detail an embodiment of the present invention. Other modifications and variations will, under the doctrine of equivalents, come within the scope of the appended claims. For example, as already mentioned, modifying the system to handle more die casting machines may be done, and this is considered an equivalent structure. Still other alternatives will also be equivalent as will many new technologies. There is no desire or intention here to limit in any way the application of the doctrine of equivalents.

What is claimed is:

1. A method for reducing pressure in casting cavities of more than one preselected die casting machine using a single pressure reducing source comprising the steps of:

providing a plurality of die casting machines, each machine providing signals based upon a die casting operating cycle;

providing a pressure reducing source;

providing a valve for each of said plurality of die casting machines, said valves for communicating the casting cavities of said plurality of die casting machines with said pressure reducing source;

selecting some of said plurality of die casting machines to be subject to pressure reduction;

communicating said signals from one of said plurality of preselected die casting machines to a first receiving element;

communicating signals from said first receiving element to a controller;

communicating signals from said controller to said pressure reducing source;

reducing pressure in the casting cavity of said one preselected die casting machine;

communicating said signals from another of said preselected die casting machines to a second receiving element;

communicating signals from said second receiving element to said controller;

communicating signals from said controller to said pressure reducing source; and reducing pressure in the casting cavity of said other preselected die casting machine.

2. A method as claimed in claim 1 wherein:

said receiving elements are relays.

3. A method as claimed in claim 2 including the steps of:

opening a valve to communicate the casting cavity with said pressure reducing source in response to a first position of a molten metal plunger;

signaling the close of said valve communicating the casting cavity and said pressure reducing source in response to a signal depending upon another position of said plunger; and signaling the end of a casting cycle whereby the system is tested.

4. A method as claimed in claim 1 including the steps of:

receiving a signal from said receiving element on a channel of an input card of said controller;

programming said controller to initiate an output signal on a channel of an output card of said controller; and routing said signal to a channel of said output card.

5. A method as claimed in claim 4 including the steps of:

using a high speed counter card to provide signals relating to the velocity of said plunger.

6. A vacuum die casting system comprising in combination:

a plurality of die casting machines, each die casting machine having a casting cavity and each die casting machine providing signals based upon a die casting operating cycle;

a pressure reducing source connected to said plurality of die casting machines;

means connecting said plurality of die casting machines and said pressure reducing source for removing gas from the casting cavities of said plurality of die casting machines;

a plurality of valves, each valve being mounted to a corresponding die casting machine and in communication with said casting cavity of said corresponding die casting machine;

a programmable logic controller including an operator interface connected to said plurality of die casting machines and to said pressure reducing source;

means connected to said plurality of die casting machines for transmitting signals from preselected die casting machines to said programmable logic controller; and means connected to said programmable logic controller for transmitting signals to said pressure reducing source in response to signals received from said preselected die casting machines.

7. A system as claimed in claim 6 wherein:

said die casting machine signal transmitting means includes a plurality of address relays, each address relay being in communication with a corresponding die casting machine.

8. A system as claimed in claim 7 wherein:

the signals from each die casting machine includes a signal relating to the completion of a die casting cycle, a signal relating to the closing of the die and a signal relating to the position of a plunger used to force molten metal into the casting cavity.

9. A system as claimed in claim 8 wherein:

said programmable logic controller includes a multi-channel input card, a multi-channel output card, two high speed counter cards and a processor.

10. A die casting system comprising:

a plurality of die casting machines;

a pressure reducing source connected to said plurality of die casting machines;

means connecting said plurality of die casting machines and said pressure reducing source for reducing pressure within selected die casting machines; and means for controlling said pressure reducing source.

* * * * *